United States Patent [19]

Sado et al.

[11] 4,416,498

[45] Nov. 22, 1983

[54] SOCKET-TYPE CONNECTORS FOR ELECTRIC CONNECTORS

[75] Inventors: Ryoichi Sado, Saitama; Kazutoki Tahara, Ageo, both of Japan

[73] Assignee: Shin-Etsu Polymer Co., Ltd., Tokyo, Japan

[21] Appl. No.: 329,325

[22] Filed: Dec. 10, 1981

Related U.S. Application Data

[63] Continuation of Ser. No. 131,687, Mar. 18, 1980, abandoned.

[30] Foreign Application Priority Data

Mar. 20, 1979 [JP] Japan ..... 54-3801

[51] Int. Cl.[3] ..... H01R 13/52

[52] U.S. Cl. ..... 339/60 R

[58] Field of Search ..... 339/21 R, 59 R, 59 M, 339/60, 61, 254, 255 R

[56] References Cited

U.S. PATENT DOCUMENTS

| | | | |
|---|---|---|---|
| 2,254,280 | 9/1941 | Gottheimer | 339/61 C |
| 2,283,398 | 5/1942 | Van Deventer | 339/21 R |
| 2,706,803 | 4/1955 | Templeton | 339/255 R |
| 2,869,040 | 1/1959 | Pifer | 339/61 R |
| 2,912,666 | 11/1959 | Hurvitz | 339/61 R |
| 3,427,551 | 2/1969 | Oshima | 339/61 R |
| 3,659,247 | 4/1972 | Chaney et al. | 339/21 R |

*Primary Examiner*—Joseph H. McGlynn

*Attorney, Agent, or Firm*—Hopgood, Calimafde, Kalil, Blaustein & Judlowe

[57] ABSTRACT

The invention provides an improvement in a socket-type connector used for making electric connection between two circuit units. Unlike a conventional socket-type connector in which a contacting element made of a metal piece in a form of something like a spring is fixed in a rigid socket, at least a part of the socket of the inventive connector is made of an electrically insulating and elastically resilient material so that a pin plug inserted into the socket is held firmly and in good reliable contact with the contacting element by virtue of the elastic resilience given by the part of the socket made of the elastically resilient material where the socket is deformed by the insertion of the pin plug to exhibit rubbery resilience.

2 Claims, 35 Drawing Figures

SOCKET-TYPE CONNECTORS FOR ELECTRIC CONNECTORS

This application is a continuation of application Ser. No. 131,687, filed Mar. 18, 1980, now abandoned.

BACKGROUND OF THE INVENTION

The present invention relates to a novel socket-type connector for electric connection in which electric connection is obtained by inserting a conductive pin plug into the socket.

In the prior art, various types of connectors are known for electrically connecting various kinds of semiconductor devices such as diodes, transistors, integrated circuits and the like as well as electronic circuit units with each other. Among them, socket-type connectors belong to one of the most popular classes of the connectors. A socket-type connector is constructed by providing one or more of contacting elements of a metal inside the pocket of a socket made of an insulating material and electric connection is obtained by inserting a pin plug of the device or circuit unit into the pocket through the mouth of the pocket. In the connectors of this type, the contacting element of metal is usually shaped in various forms something like a spring such that a resilient force is exhibited when the pin plug is inserted into the socket in order to ensure good electric connection between the pin plug and the contacting element and to prevent the pin plug from getting off the socket. In accordance with the shapes of the contacting elements and the pin plugs inserted thereinto, they are called a banana-chip type, pin-socket type, knife-plate type, tuning-fork type and the like.

One of the unavoidable problems in these prior art socket-type connectors, especially, when a miniature-sized connector is desired, is that fabrication of a large number of tiny contacting elements into spring-like forms and assembling of them in the sockets are very troublesome and time-consuming and cannot be very accurate so that the reliability and durability of such connectors are rather poor when, in particular, the pin plugs are repeatedly and frequently inserted into and pulled out of the socket-type connectors for electric connection and disconnection. This problem is more and more serious along with the growing trend for miniaturized or thin designs of electronic instruments.

An improvement for such a type of connectors has been recently proposed, for example, in U.S. Pat. No. 3,871,737, Japanese Patent Disclosure No. 50-86685 and Japanese Patent Publication No. 51-13232, in which an electroconductive rubber is used as a material for the contacting element coming into contact with the pin plugs. A problem in the connectors of this type using an electroconductive rubber is the relatively large contact resistance between the contacting element and the pin plug so that limitations are given in their use in a circuit with a relatively large electric current. Furthermore, frequent insertion and removal of the pin plug into and from the socket may sometimes lead to chipping off of the contacting element or even to complete loss of the element.

SUMMARY OF THE INVENTION

One of the objects of the present invention is, therefore, to provide a novel and improved socket-type connector for reliable electric connection free from the above described problems or drawbacks in the socket-type connection of prior art even when the size of the connector is extremely small.

Thus, the inventive socket-type connector for electric connection, in which electric connection is obtained by inserting an electro-conductive pin plug thereinto, comprises (a) a body of the socket made of an electrically insulating material with a mouth open for inserting the electroconductive pin plug forming a pocket inside the body, at least a part of the wall of the pocket being formed of an elastically resilient material, and (b) at least one contacting element of a metal located inside the pocket of the body of the socket, the part made of the elastically resilient material in the wall of the pocket being provided in such a manner that a resilient compressive force is exerted to the contacting element through the pin plug when the pin plug is inserted into the pocket through the month.

DETAILED DESCRIPTION OF THE PREFERRED EMBODIMENTS

Figure 1:
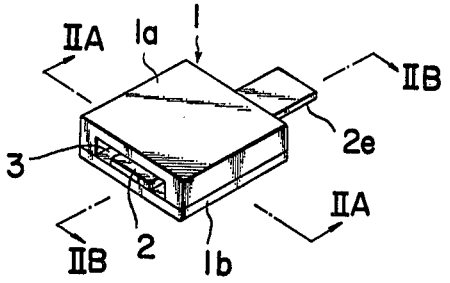
FIG. 1 is a perspective view of a basic model of the inventive socket-type connector and FIG. 2*a* and FIG. 2*b* are each a cross sectional view of the same connector.

The inventive socket-type connectors are now described in detail with reference to the drawing annexed.

Figure 2A:
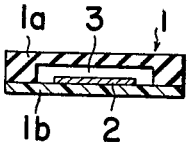
Figure 2B:
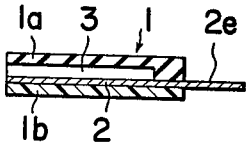

As is shown in FIG. 1 illustrating a perspective view of a typical embodiment of the invention as well as in FIG. 2*a* and FIG. 2*b* showing the cross sectional views of the same connector taken along the lines IIA—IIA or IIB—IIB, respectively, the socket-type connector of the present invention is composed of a body 1 of the socket which in turn is formed of the base plate 1*b* and the covering 1*a* forming a pocket 3 therebetween with an open mouth.

Both of the base plate 1*b* and the covering 1*a* are made of an electrically insulating material such as a synthetic plastic or rubber.

It is essential in this invention that at least a part of the body 1 of the socket is made of an insulating and elastically resilient material such as a rubber. In the embodiment illustrated in the above figures, the covering 1*a* is made of an insulating rubber while the base plate 1*b* is made of a rather rigid plastic resin. It is of course optional that both of the base plate 1*b* and the covering 1*a* are made of a rubber or the whole body 1 of the socket is shaped integrally by injection molding, compression molding or other suitable means with a rubbery insulating material.

Inside the pocket 3 of the body 1 of the above socket is placed a contacting element 2 which is fixed on the base plate 1*b* and extends out of the bottom of the pocket 3 so as to facilitate electric connection of the contacting element 2 with an external circuit (not shown in the figure) at the end 2*e* extending outwardly. The contacting element 2 is preferably made of a metallic material such as copper, brass and the like though not limited thereto.

Figure 3A:
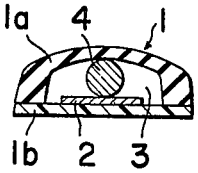
FIG. 3*a* and FIG. 3*b* are each a cross sectional view showing the connector of FIG. 1 with a pin plug inserted thereinto.
Figure 3B:
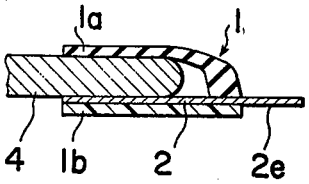

When electric connection is to be obtained between the first circuit unit connected to the end 2*e* of the contacting element 2 and a second circuit unit, which may be a transistor or an integrated circuit, a pin plug 4 provided in the second circuit unit is inserted into the pocket 3 of the socket-type connector through the mouth as is shown by FIG. 3*a* and FIG. 3*b* each corresponding to FIG. 2*a* and FIG. 2*b* so that the pin plug 4 comes into contact with the contacting element 2. In this case, the thickness of the pocket 3 is somewhat smaller than the height of the pin plug 4 so that the upper part of the covering 1*a* is elastically deformed and raised in a form something like a barrel vault. Therefore, the pin plug 4 is pressed against the contacting element 2 by the elastic resilience of the covering 1*a* with an appropriate contacting pressure ensuring good contacting condition between the pin plug 4 and the contacting element 2 and preventing the pin plug 4 from getting off the pocket 3 resulting in improved reliability of the electric connection between two circuit units.

The elastically resilient material for forming a part of the wall of the pocket 3 is not limited to a specific type of rubbers but can be a plastic resin in so far as the shaped article thereof can exhibit appropriate resilience. It is desirable that the material is heat resistant to some extent not to be deformed by the heat evolved at the contacting areas between the contacting element 2 and the pin plug 4, especially, when the connector is intended to be used in an electric circuit involving a relatively large electric current. In particular, it is a recommendable way that, when the connector is used as connected with a heat-generating circuit unit such as a power transistor, resistor element and the like, the elastically resilient material is blended with a considerable amount of a heat-conductivity improver such as boron nitride, alumina, quartz powder and the like before it is molded into the covering 1*a*.

Figure 4A:
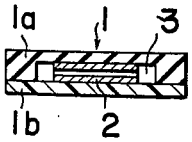
FIG. 4*a* and FIG. 4*b* are each a cross sectional view of an inventive connector having a contacting element in a form of a lapelled cantilever spring and FIG. 5*a* and FIG. 5*b* are each a cross sectional view of the same connector with a tongue-like pin plug inserted thereinto.
Figure 4B:
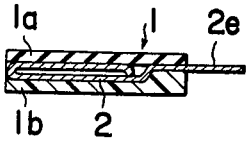
Figure 5A:
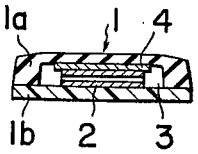
Figure 5B:
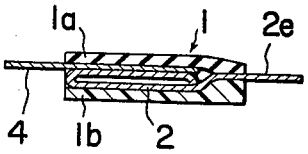

The contacting element 2 placed in the pocket 3 is, as mentioned before, made of a metal and the shape of it is not limitative although the contacting element 2 illustrated in FIGS. 1 to 3 is in a form of a single plate. It is recommendable that the plate-like contacting element 2 is bent to form a lapelled cantilever spring as is shown in FIG. 4*a* and FIG. 4*b* illustrating such a contacting element 2 by the cross section as well as in FIG. 5*a* and FIG. 5*b* illustrating the insertion of a pin plug 4 which is in a form of something like a tongue of a single plate instead of the rod in FIG. 3*a* and FIG. 3*b* into the connector of FIG. 4*a* and FIG. 4*b*. With a contacting element 2 of this type, the contacting pressure between the contacting element 2 and the pin plug 4 is obtained by both of the elastic resilience of the covering 1*b* and the spring action of the contacting element 2 per se so that further improved electric connection is obtained.

Various modifications of the above described basic models are illustrated below by way of examples.

Figure 6:
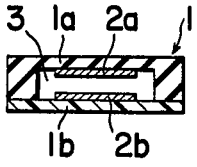
FIG. 6 to FIG. 8 are each a cross sectional view of the inventive connector having one or two contacting elements bonded to the covering portion.
Figure 7:
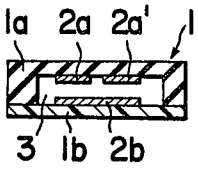

The model shown in FIG. 6 by the cross section as viewed in the direction of insertion of the pin plug has two contacting elements 2*a*, 2*b*, the element 2*a* being bonded to the covering 1*a* and the element 2*b* being bonded to the base plate 1*b*. It is optional that one or both of the contacting elements 2*a* and 2*b* are shaped in the form of the cantilever spring as shown in FIG. 4*a* and FIG. 4*b*. FIG. 7 shows a further modification of the model of FIG. 6, in which the contacting element bonded to the covering 1*a* is divided into two separate pieces 2*a* and 2*a*'. This model with separate contacting elements 2*a*, 2*a*' is used when branch connection is desired.

Figure 8:
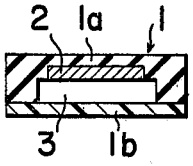

Further, the model shown in FIG. 8 has only one contacting element 2 as embedded in the lower surface of the covering 1*a*.

One of the advantages obtained in the models shown in FIG. 6 to FIG. 8 having one or more of the contacting elements bonded to the covering 1*a* is that the elastic resilience given by the elastic deformation of the covering 1*a* is further reinforced by the contacting element or elements bonded thereto contributing to the improvement of the reliability of electric connection.

Figure 9A:
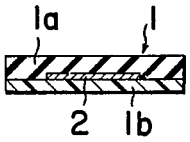
FIG. 9*a* is a cross sectional view of an inventive connector in which no or a very thin interstice is provided between the covering and the base plate to serve as a pocket for inserting a pin plug and FIG. 9*b* is a cross sectional view of the same connector with a pin plug inserted into the interstice with deformation of the covering.
Figure 9B:
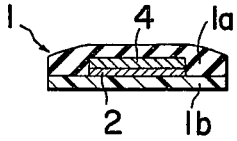

FIG. 9*a* illustrates a model of the connector having no or a very thin pocket between the covering 1*a* and the contacting element 2 bonded to the base plate 1*b* and the insertion of a tongue-like pin plug 4 between them deforms the covering 1*a* as is shown by FIG. 9*b* where the pin plug 4 is strongly fastened and pressed against the contacting element 2.

FIG. 10 to FIG. 13 show several embodiments of the inventive socket-type connectors of which the body 1 of the socket is integrally made of a rubbery elastomer and a plurality of contacting elements 2 are bonded to the inner surface of the body 1 of the socket to form a pocket 3 fitting a rod-like pin plug. These integrally shaped bodies 1 of the socket are suitable for mass production since they are molded in one shot by injection molding or other suitable rubber molding means.

Figure 14A:
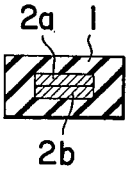
FIG. 14*a* is a cross sectional view of an inventive connector having an integrally molded body and two contacting elements between which almost no or a very thin interstice is provided and FIG. 14*b* is a cross sectional view of the same connector with a pin plug inserted thereinto.
Figure 14B:
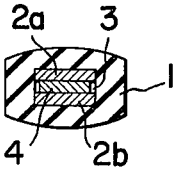

FIG. 14*a* illustrates another model with an integrally shaped body 1 of the socket and provided with two contacting elements 2*a*, 2*b* each bonded to the inner surface of the body 1 as closely positioned to each other leaving almost no pocket therebetween. When a pin plug 4 is forcibly inserted between these contacting elements 2*a* and 2*b*, the interstice between the contacting elements 2*a* and 2*b* is widened as is shown in FIG. 14*b* to form a pocket 3 in which the pin plug 4 is firmly held as pressed with resilience exerted by the rubber walls on both sides of the pin plug 4.

Figure 15:
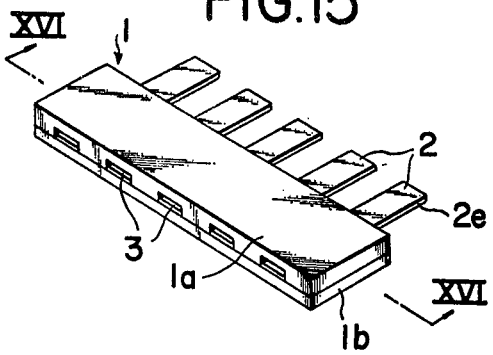
FIG. 15 is a perspective view of a multi-pin connector of the invention.
Figure 16:
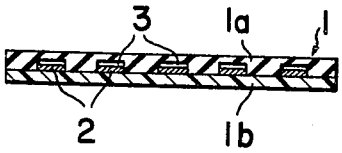
FIG. 16 is a cross sectional view of the same connector.
Figure 17:
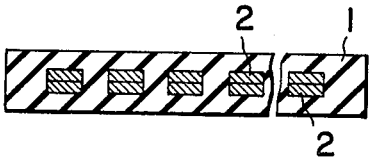
FIG. 17 is a cross sectional view of a multi-pin connector in which no or very thin interstices are provided between the opposite pairs of the contacting elements and FIG. 18 is a cross sectional view of a dually arrayed multi-pin connector of a similar type.
Figure 18:
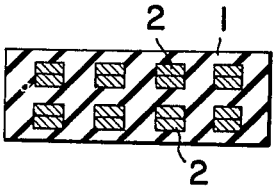

FIG. 15 and FIG. 16 illustrate a perspective view of a multi-pin connector of the invention and a cross sectional view thereof taken along the line XVI—XVI in FIG. 15, respectively. The body 1 of the multi-pin connector is composed of a base plate 1*b* and a covering 1*a* forming a plurality of pockets 3 arranged at desired intervals according to the arrangement of the pin plugs to be connected. Each of the pockets 3 is provided with a contacting element 2 of a metal as bonded on to the base plate 1*b*. This model is only a pluralized linear assembly of a plurality of the model shown in FIG. 1 so that there may be no need of further explanation. Similarly, a linear pluralization of the model shown in FIG. 14*a* gives the model shown in FIG. 17 and a dual-line pluralization of the same gives the model shown in FIG. 18.

Figure 10:
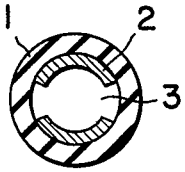
FIG. 10 to FIG. 13 are each a cross sectional view of an inventive connector having an integrally molded body and a plurality of the contacting elements.
Figure 11:
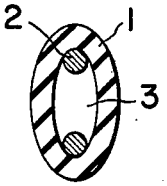
Figure 12:
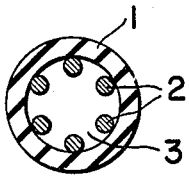
Figure 13:
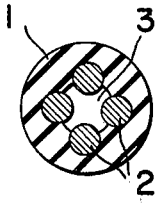
Figure 19:
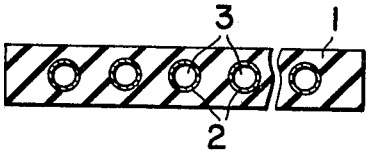
FIG. 19 is a cross sectional view of a multi-pin connector which is a single line assembly of the connector shown in FIG. 10
Figure 20:
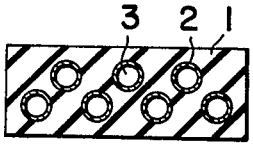
FIG. 20 is a cross sectional view of a dually arrayed multi-pin connector of a similar type.

Further similarly, a pluralization of the model shown in FIG. 10 into a single multi-pin connector may lead to the model shown in FIG. 19 or FIG. 20, of which the outer surfaces of the connector are smoothed to impart a rectangular cross section to the multi-pin connector.

The above illustrated dual-line multi-pin connectors are suitable for use, for example, to connect an integrated circuit having pin plugs arranged in dual lines. Such a dual-line multi-pin connector is, of course, formed by combining two single-line multi-pin connectors of, for example, FIG. 17 by use of a frame 5 as is shown in FIG. 21 by a perspective view.

Figure 21:
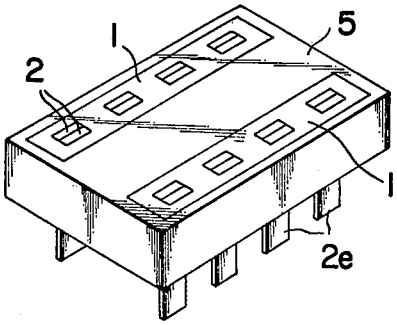
FIG. 21 is a perspective view of a dual-line multi-pin connector which is a combination of two single-line multi-pin connectors fastened with a frame.
Figure 22:
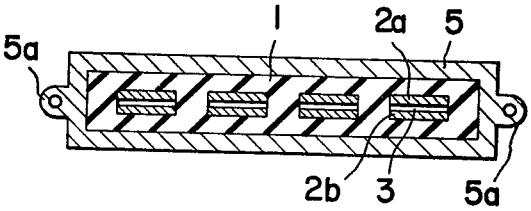
FIG. 22 is a cross sectional view of a multi-pin connector with a frame having two ears for screw mounting.

The use of a frame 5 as in the model shown in FIG. 21 is not limited to the dual-line arrangement of a multi-pin connector but a frame can be used in any type of the inventive socket-type connectors in so far as the elastic deformation of the body 1 of the socket is not unduly restricted by the frame 5. FIG. 22 illustrates the use of a frame in a single-line arrangement of a multi-pin connector shown by the cross section in which the frame 5 has two ears 5*a*, 5*a* with holes for screwing facilitating mounting of the connector on an instrument. When the frame 5 is made of a material having good heat conductivity, an additional advantage is obtained that local heating around the contacting areas of the contacting elements and the pin plugs can be made even.

Figure 23:
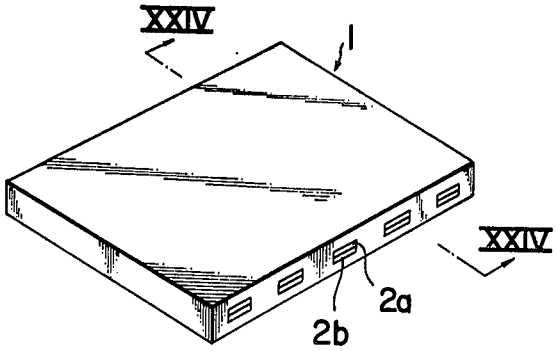
FIG. 23 is a perspective view of a bilateral multi-pin connector.
Figure 24A:
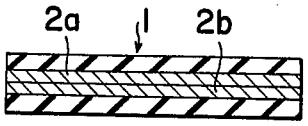
FIG. 24*a* and FIG. 24*b* are each a cross sectional view of the same bilateral connector without or with the insertion of a pin plug, respectively.
Figure 24B:
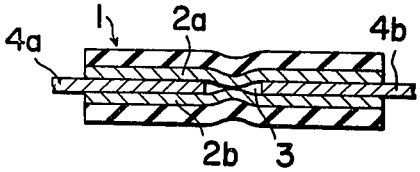
Figure 25:
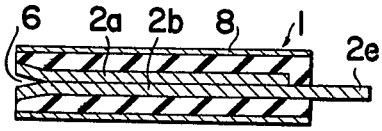
FIG. 25 and FIG. 26 are each a cross sectional view of an inventive connector having two opposite contacting elements, in which a means is provided at the opening mouth for facilitating insertion of a pin plug.
Figure 26:
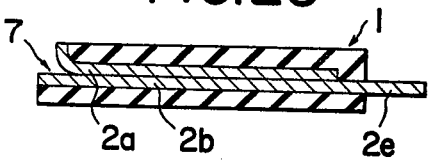

All of the models described above are designed so as that each contacting element 2 is contacted with a single pin plug 4 and one of the terminals of the contacting element 2 not in contact with the pin plug 2 is extended outwardly from the body 1 of the socket to form a connecting terminal 2*e* for a lead wire. On the other hand, FIG. 23 illustrates a perspective view of a socket-type connector of the invention and FIG. 24*a* illustrates a cross section of the same taken along the line XXIV—XXIV in FIG. 23, in which each of the pockets 3 is open at both ends from which two pin plugs 4*a*, 4*b* are inserted as shown in FIG. 24*b* to establish an electric connection between these pin plugs 4*a* and 4*b*. It is sometimes not without difficulties to insert a pin plug 4 into a so narrow interstice between the contacting elements 2*a* and 2*b* as in the socket-type connectors illustrated in FIG. 14*a* and FIG. 23. Obviation of such a difficulty is achieved by several ways. For example, as is shown in FIG. 25, the end portion of each of the contacting elements 2*a* and 2*b* is slightly bent outwardly something like an upper and a lower lips so as to form an open mouth 6. Alternatively, one of the contacting elements, e.g. 2*b*, is slightly extended to form a step-wise extension 7 and the other contacting element 2*a* is bent outwardly at the open end with a curvature as is shown in FIG. 26. This model with the step-wise extension 7 is particularly advantageous in facilitating the insertion of a pin plug 4 into the pocket 3 of the connector since the pin plug 4 is first put on the step-wise extension 7 aslant at one end thereof and then easily inserted into the interstice between the contacting elements 2*a* and 2*b* with simultaneous rotational movement of the other end with the contacting end as the fulcrum sliding on the step-wise extension 7. Note that the connector shown in FIG. 25 is provided with covering layers 8, 8 made of a plastic sheet on the outer surfaces of the body 1 so as that enhancement in the elastic resilience of the body 1 as well as protection of the body 1 from environmental influences are obtained.

Figure 27:
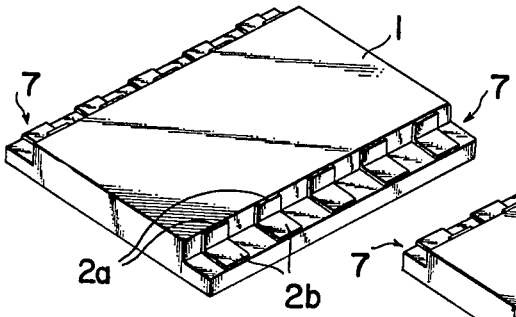
FIG. 27 is a perspective view of a bilateral multi-pin connector having a structure of the mouths similar to that shown in FIG. 26.
Figure 28:
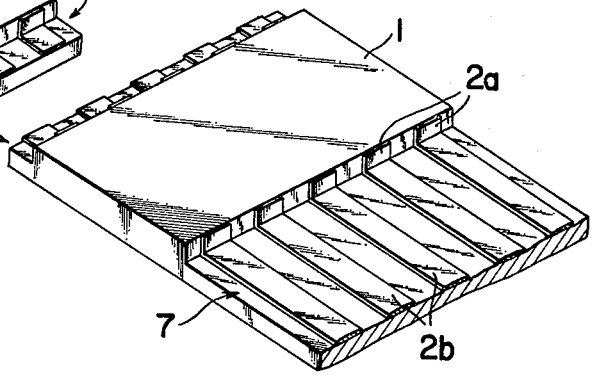
FIG. 28 is a perspective view of the bilateral multi-pin connector as shown in FIG. 27, in which a set of the contacting elements is extended in one direction to form a continuous length serving as a flat cable.

FIG. 27 is a perspective view of an improved socket-type connector for bilateral insertion of pin plugs as is shown in FIG. 23 provided with step-wise extensions 7, 7 on both ends of the contacting elements 2*b*. FIG. 28 illustrates a perspective view of a further modification of the bilateral socket-type connector of FIG. 27, in which one of the step-wise extentions 7 is further extended in continuous length so as that an integrated body of a flat cable and a connector at one end thereof is obtained.

The multi-pin connectors illustrated in FIG. 23, FIG. 27 and FIG. 28 are shown to have a flat form as a whole but, the bodies 1 of them being shaped integrally with a rubbery resilient material, they can be used as bent at a desired angle so that they are useful for connecting two circuit units which are not in coplanar positions but positioned at angled positions with each other.

As is understood from the above given description, the socket-type connectors of the present invention are very advantageous in giving a reliable electric connection with stable contact resistance regardless of the dimensional accuracy of the arrangement in the connector per se or in the pin plugs to be inserted into the connector since the elastic deformation compensates for the discrepancy in the positions of them. Furthermore, any small-sized connectors can be manufactured according to the present invention owing to the simple structure of the inventive connector and inventive connectors are inexpensive because the main part of them is easily obtained by compression molding, injection molding or other conventional inexpensive method.

What is claimed is:

1. A socket-type connector in which the electrical connection is secured by inserting an electroconductive plate-like plug thereinto comprising:

(a) a base plate formed of an electrically insulating rigid material;

(b) a socket body formed of an electrically insulating and elastically resilient material covering said base plate forming a flat pocket with the base plate;

(c) at least one plate-like contacting element formed of a conductive material located inside said pocket formed by said base plate and said socket body, said contacting element being bonded to at least one of said base plate and said socket body and being urged into close contact by said resilient socket with the other of said socket body and said base plate so as to leave no void space within the pocket; and (d) said socket body being bonded to said base plate on opposite sides of said contacting element along the direction of insertion of said plug, said socket body being elastically deformable to expand said pocket to form a void space for receiving said plate-like plug inserted thereinto, said plug being subjected to compressive force and urged against said contacting element due to the resilient deformation of said socket body.

2. A socket-type connector in which the electrical connection is secured by inserting an electroconductive plug thereinto comprising:

(a) a socket body formed of an electrically insulating and elastically resilient material for receiving said electroconductive plug; and (b) at least two plate-like contacting elements formed from metallic material located inside said pocket of the socket body, said contacting elements being bonded to the inner walls of said socket body in opposed relationship, said socket body defining upper, lower and side walls around said contacting elements, said upper, lower and side walls being free from openings, and said contacting elements being urged together by said resilient material of said socket body into direct contact with each other over their entire length so that no void space is left between said contacting elements when said plug is not inserted in said socket body, when said plug is inserted between said contacting elements said plug being subjected to a compressive force due to the resilient deformation of said socket body and said contacting elements.

* * * * *

UNITED STATES PATENT AND TRADEMARK OFFICE

CERTIFICATE OF CORRECTION

PATENT NO. : 4,416,498

DATED : November 22, 1983

INVENTOR(S) : Sado et al.

It is certified that error appears in the above-identified patent and that said Letters Patent are hereby corrected as shown below:

IN THE TITLE

Please change the title to read as follows

-- SOCKET-TYPE CONNECTORS FOR ELECTRIC CONNECTION --.

Signed and Sealed this

*Thirty-first* Day of *January 1984*

[SEAL]

*Attest:*

GERALD J. MOSSINGHOFF

*Attesting Officer*

*Commissioner of Patents and Trademarks*